US006204233B1

(12) United States Patent
Smith et al.

(10) Patent No.: US 6,204,233 B1
(45) Date of Patent: Mar. 20, 2001

(54) LAUNDRY PRE-TREATMENT OR PRE-SPOTTING COMPOSITIONS USED TO IMPROVE AQUEOUS LAUNDRY PROCESSING

(76) Inventors: Kim R. Smith, 8774 Rainier Alcove, Woodbury, MN (US) 55125; Carrie L. Armstrong, 510 Mahtomedi Ave, Mahtomedi, MN (US) 55115; Paul J. Mattia, 8876 Oak Hill La., Prior Lake, MN (US) 55372; Mark Levitt, 429 Front Ave., St. Paul, MN (US) 55117; Robert D. P. Hei, 2224 30th Ave., Baldwin, WI (US) 54002; Wendy M. Wiseth, 390 Geranium Ave. East, St. Paul, MN (US) 55101

( * ) Notice: Subject to any disclaimer, the term of this patent is extended or adjusted under 35 U.S.C. 154(b) by 0 days.

(21) Appl. No.: 09/167,601

(22) Filed: Oct. 7, 1998

(51) Int. Cl.[7] ..... C11D 1/72; C11D 1/722; C11D 1/825

(52) U.S. Cl. ..... 510/283; 510/276; 510/342; 510/356; 510/421; 510/405; 510/413; 510/528

(58) Field of Search ..... 510/276, 283, 510/342, 356, 421, 405, 413, 528

(56) References Cited

U.S. PATENT DOCUMENTS

| | | | | |
|---|---|---|---|---|
| 3,417,023 | | 12/1968 | Di Salvo | 252/118 |
| 3,635,829 | | 1/1972 | Yang | 252/526 |
| 3,664,962 | | 5/1972 | Kelly et al. | 252/125 |
| 3,953,353 | * | 4/1976 | Barrett, Jr. et al. | 252/174 |
| 4,020,016 | * | 4/1977 | Sokol | 252/546 |
| 4,199,482 | * | 4/1980 | Renaud et al. | 252/559 |
| 4,289,644 | * | 9/1981 | Steinhauer et al. | 252/127 |
| 4,295,845 | * | 10/1981 | Sepulveda et al. | 8/139.1 |
| 4,362,638 | * | 12/1982 | Caskey et al. | 252/90 |
| 4,396,521 | * | 8/1983 | Borrello | 252/118 |
| 4,430,236 | * | 2/1984 | Franks | 252/95 |
| 4,457,857 | * | 7/1984 | Sepulveda et al. | 252/174.21 |
| 4,530,781 | * | 7/1985 | Gipp | 252/546 |
| 4,595,527 | * | 6/1986 | Gipp | 252/546 |
| 4,711,739 | * | 12/1987 | Kandathil | 252/139 |
| 4,836,949 | | 6/1989 | Klajnscek | 252/135 |
| 4,842,762 | | 6/1989 | Sabol, Jr. et al. | 252/109 |
| 4,861,516 | * | 8/1989 | Kurzendoerfer et al. | 252/531 |
| 4,877,556 | * | 10/1989 | Wilsberg et al. | 252/544 |
| 4,909,962 | * | 3/1990 | Clark | 252/547 |
| 4,911,860 | * | 3/1990 | Van Den Brom | 252/174.21 |
| 4,954,286 | * | 9/1990 | Sepulveda et al. | 252/174.22 |
| 5,035,826 | * | 7/1991 | Durbut et al. | 252/121 |
| 5,205,960 | * | 4/1993 | Kristopeit et al. | 252/174.24 |
| 5,288,420 | * | 2/1994 | Mandy | 252/121 |
| 5,364,551 | | 11/1994 | Lentsch et al. | 252/156 |
| 5,370,729 | | 12/1994 | Man et al. | 106/2 |
| 5,484,553 | * | 1/1996 | Guth et al. | 252/351 |
| 5,490,948 | * | 2/1996 | Klier et al. | 252/122 |
| 5,503,838 | | 4/1996 | Schmidt et al. | 424/407 |
| 5,538,662 | * | 7/1996 | Klier et al. | 252/122 |
| 5,648,326 | * | 7/1997 | Sramek | 510/284 |
| 5,750,484 | | 5/1998 | Falbaum et al. | 510/276 |

FOREIGN PATENT DOCUMENTS

WO 96/26999 9/1996 (WO) .

OTHER PUBLICATIONS

Surfonic® Brochure: Table 2, Physical Properties and Typical Analytical Values of Surfonic® Linear Alcohol Ethoxylates, 2 pgs. (date unknown).

* cited by examiner

*Primary Examiner*—Yogendra Gupta
*Assistant Examiner*—Charles Boyer
(74) *Attorney, Agent, or Firm*—Merchant & Gould P.C.

(57) ABSTRACT

The ability of aqueous laundry compositions to remove organic hydrophobic soils, such as oily, greasy or particulate soils, from a laundry item is substantially improved by pre-spotting or pre-treating such a soiled item with a treatment composition having a surfactant comprising a unique hydrophillic ethoxylate surfactant with less than two moles of ethylene oxide or a or blend of at least two surfactant compositions with a blended HLB value of about 7–12. The blend of surfactants with this HLB value penetrates soils and renders the soil more easily removed from the item using aqueous laundry detergent. The treatment composition can be used in a liquid or solid form and can be applied to individual laundry items in the form of a solid stick or liquid spray prior to introduction to the laundry machine. Laundry items can also be contacted in the laundry machine with the pre-spot or pre-treatment composition in the form of an aqueous presoak, preflush, prewash, or other step prior to the cleaning step. A preferred laundry machine comprises an institutional tunnel washer.

21 Claims, No Drawings

LAUNDRY PRE-TREATMENT OR PRE-SPOTTING COMPOSITIONS USED TO IMPROVE AQUEOUS LAUNDRY PROCESSING

FIELD OF THE INVENTION

The invention relates to a laundry chemicals and specifically to a pre-spot or a pre-treatment composition that can be contacted with soiled location or a spotted deposit on a fabric item prior to a conventional laundry cleaning step. The aqueous liquid or solid treatment composition is formulated with a surfactant or a combination of organic surfactants that can prepare the soiled areas or spots for cleaning and promote the removal of stubborn hydrophobic greasy or oily soils, including associated organic particulate soils, such as finely divided elemental carbon, in the laundry/cleaning step. The properties of the surfactant or blended surfactant combination is selected to provide enhanced soil removal, preferably in institutional laundry applications.

BACKGROUND OF THE INVENTION

The invention relates to a solid or liquid pre-treatment or pre-spot composition that can promote the removal of stains or soil from fabric during conventional laundering procedures. Detergent pre-treatment or pre-spotting compositions, solids or sticks are known in the art and are known to commonly use solvent materials and typically nonionic surfactants. For example, DiSalvo, U.S. Pat. No. 3,417,023; Kelly, et al., U.S. Pat. No. 3,664,962; Steinhauer et. al., U.S. Pat. No. 4,289,644; and Sabol, Jr. et al., U.S. Pat. No. 4,842,762. Each separately claim pre-treatment or pre-spotting compositions containing a small amount of water and a substantial proportion of solvent, nonionic surfactant and a solidification or gelling agent. Borrello, U.S. Pat. No. 4,396,521 teaches liquid aqueous pre-spot or pre-treatment compositions containing about 35 wt % water and substantial water soluble solvent compositions to create a use solution. Such aqueous and solvent based materials are typically less effective on oily hydrophobic soils due to the nature of the soil and its hydrophobicity with respect to the aqueous formulated materials. The solvent based laundry pre-treatment stick is disclosed in Steinhauer et al., U.S. Pat. No. 4,289,644, comprises a minor amount of water but relatively large percent of immiscible solvent in separate but combined phases. We are also aware of Klier et al., U.S. Pat. No. 5,538,662 and Yang, U.S. Pat. No. 3,635,829, each relating to similar pre-spot or pre-treatment compositions. One liquid detergent composition having a specialized phosphate ester solubilizer is disclosed in Klajnscek, U.S. Pat. No. 4,836,949. The patent discloses preferred formulations for use in a liquid stabilized laundry detergent.

While these prior art pre-spot or pre-treatment compositions have some utility in pre-spotting common household laundry, commercial laundry having large quantities of hydrophobic soils, particularly oily or greasy soils containing substantial quantities of particulate matter, can resist conventional pre-spotting pre-treatments and also resist the effects of conventional laundry detergents even in industrial or commercial laundry machines such as commercial 450 pound wash wheels or tunnel washers. A substantial need exists for improved pre-spotting or pre-treating laundry compositions.

BRIEF DISCUSSION OF THE INVENTION

The pre-spot or pre-treatment compositions of the invention are formulated to be useful in preparing garments or fabric items for final laundering in a conventional, typically institutional, laundry machine using conventional laundry detergent materials. We have found a useful laundry pre-treatment or pre-spot blended composition that can be contacted with soiled fabric or garments to promote the removal of hydrophobic soils. The composition can use one unique nonionic surfactant:

$$R—(OC_2H_4)_n—OH$$

wherein R is a hydrophobic or fatty residue and n is less than 2. This surfactant can be used in a pretreatment step in a dilute aqueous solution or can be applied as a spray or pre-spot, rub-on solid.

Alternatively, the pre-treatment comprises a blend of at least one relatively hydrophilic (Hydrophilic Lipophilic Balance (HLB) greater than 10) nonionic surfactant with at least one relatively hydrophobic (HLB less than 10) nonionic surfactant producing a blended surfactant having an HLB weighted average or HLB total value of about 7 to 12, preferably 8 to 11 and most preferably 9 to 10. More specifically, the composition can comprise a relatively hydrophilic ethoxylate surfactant combined with a relatively hydrophobic alcohol ethoxylate surfactant at proportions that produce the desired HLB value. The hydrophilic surfactant can further comprise a relatively hydrophilic alcohol ethoxylate, a relatively hydrophilic alkyl phenol ethoxylate or mixtures thereof. The relatively hydrophilic ethoxylate surfactant typically comprises one or more surfactant species, each having an HLB value of about 10 to 20. The relatively hydrophobic alcohol ethoxylate surfactant, comprises one or more similar surfactant species, typically a $C_{6-24}$ fatty alcohol ethoxylate having less than 2 moles ethylene oxide and an HLB value of less than about 9, preferably about 4 to 9. The HLB system is well known to skilled surfactant chemists and is explained in the literature such as in the publication, "The HLB System," ICI Americas (1987). This publication recommends that detergents for laundry have an HLB of about 13–15.

An important embodiment of the invention involves a blend of three nonionic surfactants to form the blend with the desired HLB value. The composition comprises a first relatively hydrophilic ethoxylate, preferably an alkyl phenol ethoxylate surfactant having 9 to 10 moles of ethylene oxide with an HLB of 13–14, a second relatively hydrophobic, preferably an alkyl phenol ethoxylate, surfactant having 4–5 moles of ethylene oxide with a HLB of 9–10 and a relatively hydrophobic fatty alcohol ethoxylate surfactant having less than about 2 moles of ethylene oxide. The surfactant has an HLB of less than 7. We have found that either the unique surfactant or the blended surfactant composition, can associate with hydrophobic greasy soils and in particular, hydrophobic greasy soils with a substantial proportion of organic particulates dispersed throughout the greasy soil to form a treated soil. This treated soil then can be readily removed by conventional laundry detergent and equipment.

The surfactant or surfactant blend can operate, without substantial amounts of the conventional solvent typical in common aqueous dilute pretreatment compositions, to soften, dissolve into or associate with or otherwise pre-treat or pre-spot the hydrophobic soils. The presence of the surfactant or blend in a pre-treated soil renders the soils uniquely subject to cleaning and substantially complete removal in institutional laundry machines with conventional laundry detergents. The term "ethoxylate surfactant"means a surfactant that contains at least one block of polymerized ethylene oxide [$(EO)_x$, x is a number of 1 to 100] along with any other common surfactant moiety to form a surfactant molecule that provides the HLB needed for the blend. The pre-treatment compositions of the invention can be formed in a concentrated water-free, aqueous, or a thickened aqueous liquid concentrate containing 50 to 100 wt % of the active materials that can be diluted with water and applied or sprayed where needed. The compositions can also be prepared in the form of a pre-spotting or pre-treatment stick or solid block which can be contacted or rubbed into the soil to perform the pre-treatment step. Alternately, the solid pretreatment can be dispensed in a water spray-on dispenser that provides an aqueous or non-aqueous concentrate composition. Both the liquid and solid pre-treatment compositions can contain other conventional laundry builder salts and optional compositions. The inventive compositions, however, are substantially free of any solvent material. The surfactant blends of the invention are generally not considered to be solvents. Typical solvents are aliphatic and aromatic hydrocarbons, alcohols, ether compounds, fluorocarbon compounds, and other similar low molecular weight generally volatile liquid materials. In this sense water is not a solvent but when used acts as a diluent for the active materials.

DETAILED DESCRIPTION OF THE INVENTION

The invention relates to liquid and solid detergent compositions comprising the unique surfactant of the invention or about 0.01 to 50 wt % of a first relatively hydrophilic ethoxylated surfactant composition or blend thereof and about 50 to 100 wt % of a second relatively hydrophobic alcohol ethoxylate composition or blend thereof. The HLB value for the first relatively hydrophobic ethoxylate surfactant falls within the range of about 9 to about 10. The HLB value of the second relatively hydrophobic alcohol ethoxylate composition falls in the range of about 6 to 8. The preferred pre-treatment or pre-spotting compositions can contain a third relatively hydrophilic alkyl phenol ethoxylate surfactant composition wherein the alkyl group has about 8 to 10 carbon atoms and the ethoxylate group has about 8 to 12 moles of ethylene oxide, preferably about 9 to 10 moles of ethylene oxide and an HLB value of about 13 to 14.

The blended surfactant materials, when combined in the pre-treatment composition, has an weighted average HLB of about 7 to 12. For the purpose of this patent application, the term "weighted average HLB (also expressed as $HLB_{ave}$)" or "total HLB" can be measured by measuring the HLB value of the final surfactant blend or can be calculated according to the following algorithm:

$$HLB_{ave}=\Sigma x_i HLB_i; \quad \text{I}$$

$$\text{For three surfactants } HLB_{ave}=x_1[HLB_1]+x_2[HLB_2]+x_3[HLB_3] \quad \text{II}$$

Wherein, in formula I, $x_i$ is the weight fraction of surfactant and the $HLB_i$ is its associated HLB. In formula II, a formula for calculating average HLB for a three component is shown, however, formula I can be adapted for two components, three components, four components, five components or more wherein the coefficient $x_i$ comprise the weight percent of the component of the pre-treatment composition. Such $x_i$ coefficients must sum to 100 wt %. The $HLB_i$ comprises the HLB value of the surfactant used at the weight percent recited in the coefficient.

The hydrophilic ethoxylate surfactant which can be used in the present invention comprise the formula:

$$R_1—(OC_2H_4)_m—(OC_3H_6)_n—OH$$

wherein there are sufficient ethylene oxide (also known as EO or $—OC_2H_4—$) to obtain an HLB of at least 10. $R_1$ is a straight or branched chain alkyl group containing from about 6 to 24 carbon atoms, m is an integer of about 5 to about 12, n is an integer of about 0 to about 10, wherein m+n=6 to 20. The hydrophilic alkyl phenol ethoxylate compositions of the invention useful in the pre-treatment compositions are of the formula:

$$Ar—(OC_2H_4)_p—(OC_3H_6)_q—OH,$$

preferably $$Ar—(OC_2H_4)_p—OH;$$

wherein Ar is:

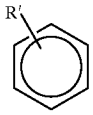

wherein R' is a straight or branched alkyl group of about 6 to 14 carbon atoms, preferably about 8 to 12 carbon atoms, p is about 6 to about 12, q is about 0 to about 10 and p plus q is preferably about 6 to 20. One preferred embodiment of the invention uses a first alkyl phenol ethoxylate in an amount of about 10 to 25 wt %, having an HLB value of about 13 to 14, a second alkyl phenol ethoxylate in an amount of about 10 to 25 wt % having an HLB value of about 8 to 10 combined with a fatty alkyl ethoxylate surfactant having about 1 EO in an amount of about 50 to 100 wt %, having an HLB value of about 6 to 8. These materials are blended in an aqueous or non-aqueous pre-treatment composition.

The hydrophobic alcohol ethoxylate which can be used in the present invention comprise the formula $$R_2—(OC_2H_4)_r—(OC_3H_6)_s—OH$$

wherein HLB value is less than 10, preferably 4 to 9, $R_2$ is a straight or branched chain fatty alkyl group containing from about 6 to 24 carbon atoms, preferably about 10 to 18 carbon atoms and most preferably about 12 to 18 carbon atoms, r is a number of about 1. s is a number of about 0 to about 10, with a total of r+s=about 1. The preferred hydrophobic alcohol ethoxylate which can be used in the present invention has an HLB value of less than 9 and can comprise the formula:

$$R_2—(OC_2H_4)_m—OH$$

wherein $R_2$ is a straight or branched chain fatty alkyl group containing from about 6 to 24 carbon atoms, preferably about 10 to 18 carbon atoms and most preferably about 12 to 18 carbon atoms, m is an integer of less than about 2.

The thickened liquid or solid brick or stick pretreatment or pre-spot compositions of the invention can be prepared in aqueous solution using about 0.01 to 5 wt.-% of a substantially soluble organic or inorganic thickener material in the liquid composition. Inorganic thickeners typically comprise clays, silicates and other well known inorganic thickeners. Organic thickeners include thixotropic and non-thixotropic thickeners. Preferred thickeners have some substantial proportion of water solubility to promote easy removability. Examples of useful soluble organic thickeners for the compositions of the invention comprise carboxylated vinyl polymers such as polyacrylic acids and sodium salts thereof, ethoxylated cellulose, polyacrylamide thickeners, xanthan thickeners, guargum, sodium alginate and algin by-products, hydroxy propyl cellulose, hydroxy ethyl cellulose and other similar aqueous thickeners that have some substantial proportion of water solubility. Preferred thickeners for use in the invention include xanthan thickeners under the name of Keltrol and Kelzan. Such xanthan polymers are preferred due to their high water solubility and substantial thickening capacity.

A hardening agent, as used in the present method and compositions, is a compound or system of compounds, organic or inorganic, that significantly contributes to the uniform solidification of the composition. Preferably, the hardening agent is compatible with the active ingredients of the composition, and is capable of providing an effective amount of hardness or aqueous solubility to the processed composition. The hardening agent should also be capable of forming a homogeneous matrix with the ingredients when mixed and solidified to provide a uniform dissolution of the cleaning agent from the solid composition during use. The amount of hardening agent included in the cleaning composition will vary according to the type of cleaning composition being prepared, the ingredients of the composition, the intended use of the composition, the quantity of dispensing solution applied to the solid composition over time during use, the temperature of the dispensing solution, the hardness of the dispensing solution, the physical size of the solid composition, the concentration of the other ingredients, the concentration of the cleaning agent in the composition, and other like factors. It is preferred that the amount of the hardening agent is effective to combine with the cleaning agent and other ingredients of the composition to form a homogeneous mixture under continuous mixing conditions and a temperature at or below the melting temperature of the hardening agent.

The hardening agent can form a matrix with the cleaning agent and other ingredients which will harden to a solid form under ambient temperatures of about 30–50° C., preferably about 35–45° C., after mixing ceases and the mixture is dispensed from the mixing system, within about 1 minute to about 3 hours, preferably about 2 minutes to about 2 hours, preferably about 5 minutes to about 1 hour. A minimal amount of heat from an external source may be applied to the mixture to facilitate processing of the mixture. It is preferred that the amount of the hardening agent included in the composition is effective to provide a hardness and desired rate of controlled solubility of the processed composition when placed in an aqueous medium to achieve a desired rate of dispensing the cleaning agent from the solidified composition during use. Preferably, the hardening agent is present in an amount of about 0.01–20 wt-%, preferably about 0.05–5 wt-%, preferably about 0.1–3 wt-%. Another preferred hardening agent is a polyethylene glycol (PEG) or propylene glycol compound for use in a cleaning composition comprising a nonionic surfactant cleaning agent, such as a nonyl phenol ethoxylate, a linear alkyl alcohol ethoxylate, an ethylene oxide/propylene oxide block copolymers such as the surfactants available commercially under the trademark PLURONIC® from BASF-Wyandotte. The solidification rate of cleaning compositions comprising a polyethylene glycol hardening agent made according to the invention will vary, at least in part, according to the amount and the molecular weight of the polyethylene glycol added to the composition.

Preferred polyethylene glycol compounds useful according to the invention include, for example, solid polyethylene glycols of the general formula $H(OCH_2—CH_2)_nOH$, where n is greater than 15, more preferably about 30–1700. Solid polyethylene glycols which are useful are marketed under the trademark Carbowax®, and are commercially available from Union Carbide. Preferably, the polyethylene glycol is a solid in the form of a free-flowing powder or flakes, having a molecular weight of about 3000–100,000, preferably about 3000–8000. Suitable polyethylene glycol compounds useful according to the invention include, for example, PEG 3000, PEG 4000, PEG 6000, PEG 8000 among others, with PEG 8000 being preferred.

The hardening agent may also be a hydratable substance such as an anhydrous sodium carbonate, anhydrous sodium sulfate, or combination thereof. Preferably, the hydratable hardening agent is used in an alkaline cleaning composition which includes ingredients such as a condensed phosphate hardness sequestering agent and an alkaline builder salt, wherein the amount of caustic builders is about 5–15 wt-%, as disclosed, for example, in U.S. Pat. Nos. 4,595,520 and 4,680,134 and Re. No. 32,818, the disclosures of which are incorporated by reference herein. A hydratable hardening agent, according to the invention, is capable of hydrating to bind free water present in a liquid detergent emulsion to the extent that the liquid emulsion becomes hardened or solidified to a homogenous solid. The amount of a hydratable substance included in a detergent composition processed according to the invention, will vary according to the percentage of water present in the liquid emulsion as well as the hydration capacity of the other ingredients. Preferably, the composition will comprise about 10–60 wt-% of a hydratable hardening agent, preferably about 20–40 wt-%.

Other hardening agents that may be used in a cleaning composition processed according to the invention include, for example, urea, also known as carbamide, starches that have been made water-soluble through an acid or alkaline treatment process, and various inorganics that impart solidifying properties to a heated liquid matrix upon cooling. Advantageously, a cleaning composition processed according to the invention may comprise an amount of hardening agent which is about 50–85% lower than that included in a corresponding composition comprising substantially the same ingredients but prepared by another method such as a "molten process" known in the art. For example, where polyethylene glycol-based cleaning compositions would typically comprise about 10–30 wt-% polyethylene glycol hardening agent when made according to another method practiced in the art, a corresponding cleaning composition made according to the present process will comprise a reduced amount of the hardening agent, or about 3–15 wt-% polyethylene glycol, preferably about 5–8 wt-%, preferably about 2–6 wt-%, preferably about 5–6 wt-%.

The pre-treatment or pre-spot compositions of the invention can contain water soluble detergency builder materials capable of enhancing pre-treatment, sequestering hardness cations from service water, providing alkaline buffering for wash solutions and other known builder functions. Suitable builders include sodium or potassium nitrilotriacetate, sodium or potassium tripolyphosphate, tetrasodium or tetrapotassium pyrophosphate, soluble citrate salts, N-alkyl taurates, alkyl isethionates, cationic polymeric acrylates or copolymers thereof, zeolites, sodium alumina silicates, and other materials. The detergents, the builders of the invention can be present in amounts of from about 5 to 25 wt % of the total composition, preferably about 5 to 15 wt %. The optimal levels of builder salt materials will vary depending on the builders chosen and the surfactant blend.

The compositions of the invention may also contain additional typically nonactive materials, with respect to cleaning properties, generally found in liquid pre-treatment or detergent compositions in conventional usages. These ingredients are selected to be compatible with the materials of the invention and include such materials as fabric softeners, optical brighteners, soil suspension agents, germicides, pH adjusting agents, viscosity modifiers, perfumes, dyes, inorganic carriers, solidifying agents and the like.

The compositions of the invention can be formulated in an aqueous liquid, a non-aqueous liquid, a thickened aqueous liquid, or a solid product form. In the aqueous liquid formulations, the surfactant ingredients of the invention are blended with an aqueous diluent to form a concentrate solution which can then be diluted at a use locus to active levels. The thickened liquid product form can be manufactured in an aqueous diluent with a thickening agent. Similarly, the thickened liquid can be diluted with water to form a use solution which is then used in a laundry machine. Alternatively, the thickened liquid material can be directly contacted with the soiled garment or fabric to treat stains or soils prior to laundering. The solid compositions of the invention can be made by combining the active surfactant materials with a solid forming agent or hardening agent. The solid compositions of the invention can then be dispensed from a spray on dispenser as a concentrated use solution which can then be diluted with water prior to use or the concentrate can be directly contacted with the soiled item. The solid formulations of the invention can also be contacted directly with a soiled or spotted area on the fabric or garment. Typically, the solid materials of the invention can be prepared by blending the active surfactant ingredients with a solid forming agent under conditions that promote blending of the materials to a uniform composition. The blended composition is then placed into forms or extruded through an appropriately sized die to form the solid treatment compositions.

The following tables generally describe formulation parameters for the various product formats of the invention.

TABLE 1

Aqueous Solution

| INGREDIENT | HLB | Useful Wt % | Preferred Wt % |
|---|---|---|---|
| fatty alcohol ethoxylate, less than 2 moles EO | 4 to 9 | 0.1 to 100 | 80 to 100 |
| water | — | q.s. | q.s. |

TABLE 2

Aqueous Solution

| INGREDIENT | HLB | Useful Wt % | Preferred Wt % |
|---|---|---|---|
| ethoxylate nonionic surfactant | <10 | 0.1 to 33 | 0.1 to 33 |
| ethoxylate nonionic surfactant | 10 to 15 | 0.0 to 33 | 0.1 to 33 |
| fatty alcohol ethoxylate, less than 2 moles EO | 4 to 9 | 0.1 to 33 | 0.1 to 33 |
| water | — | q.s. | q.s. |

TABLE 3

Thickened Aqueous Liquid

| INGREDIENT | HLB | Wt % |
|---|---|---|
| ethoxylate nonionic surfactant | <10 | 0.1 to 33 |
| ethoxylate nonionic surfactant | 10 to 15 | 0.0 to 33 |
| $C_{12-14}$fatty alcohol ethoxylate, less than 2 moles EO | 4 to 9 | 0.1 to 33 |
| Thickener | — | 0.01 to 5 |
| water | — | q.s. |

TABLE 4

Solid Formulation

| INGREDIENT | HLB | Wt % |
|---|---|---|
| ethoxylate nonionic surfactant | <10 | 0.1 to 33 |
| ethoxylate nonionic surfactant | 10 to 15 | 0.0 to 33 |
| $C_{12-14}$fatty alcohol ethoxylate; less than 2 moles EO | 4 to 9 | 0.1 to 33 |
| hardening agent | — | 0.01 to 5 |
| water | — | q.s. |

The compositions of the invention are typically used by metering into a commercial or tunnel washing machine, a useful amount of the formulated pre-spot or pre-treatment compositions in a prewash cycle or a prewash portion of a tunnel washer. The concentration of materials is typically at about 0.01 to 2 wt % in the aqueous solution in the washer used to pre-treat the garments or fabric. The garments or fabric are typically treated at ambient or elevated temperatures, typically about 20° C. to about 60° C., preferably about 22° C. to about 30° C. for a sufficient period of time to pre-treat spots and stains. Typically, depending on the concentration of the surfactant blend used, the pre-treatment can be contacted with the stains for about 10 to about 600 seconds, preferably about 20 to about 300 seconds. Typically, agitation of the composition of the clothing does not substantially improve treatment as long as the stains are saturated with the treatment solution. In order to promote saturation, the washer load can be agitated mechanically. Alternatively, the treatment compositions of the invention can be directly contacted with the soiled fabric or garment prior to introducing the soiled item into the washing machine. Typically, the material is sprayed or physically contacted with the soiled item. In the case of the use of a liquid material, common spray, nebulizer, or other equivalent that can apply the liquid material directly to the stain or spot can be used. In using the solid formulations of the invention, the solid block or stick can be directly contacted with the stain or spot leaving the solid formulation in the form of a thin film or residue substantially covering the entirety of any spot or stain on the garment. The pre-treated garment can be left to permit the surfactant compositions of the formulation to associate with the stain to pre-treat the stain or spot outside the washing machine. However, the pre-treated garment or fabric can be immediately introduced into a prewash or pre-treatment cycle or stage of the tunnel washer. The washing machine can, at this time, contain an aqueous diluent that can aid in pre-treating the soiled items or the items can be simply introduced into the washing machine without aqueous materials to simply permit the pre-treatment compositions to complete pre-treating the soil prior to a conventional laundry step. While the pre-spot and pre-treatment compositions of the invention can be used with any laundry composition, the formulations disclosed in Falbaum et al., U.S. Pat. Nos. 5,523,000; 5,741,768 and 5,750,484 are preferred.

The foregoing discussion of the invention provides a basis for understanding the ingredients and compositions of the invention. The following exemplary material and data provide a further explanation of the application of the invention to laundry processes and disclose a best mode.

EXAMPLE 1

Into a blending equipment was placed the following ingredients:

| Ingredient | Parts by Weight |
|---|---|
| Nonyl phenol ethoxylate (about 11 mole ethoxylate, HLB 13.8) | 36 |
| Lauryl/myristyl ($C_{12-14}$) fatty alcohol ethoxylate (1.3 mole ethoxylate, HLB 7) | 64 |

which were blended until uniform. The composition has a measured average HLB of 9.4 and 1% cloud point less than 80° F. (27° C.).

EXAMPLE 2

Into a blending equipment was placed the following ingredients:

| Ingredient | HLB | Parts by Weight |
|---|---|---|
| Nonyl phenol ethoxylate (12 moles ethoxylate) | 14.2 | 12 |
| Nonyl phenol ethoxylate (9.5 moles ethoxylate) | 13.4 | 24 |
| Lauryl/myristyl ($C_{12-14}$) fatty alcohol ethoxylate (1.3 moles ethoxylate) | 7 | 64 |

which was blended until uniform.

A field test was conducted in which the pre-treatment compositions of the invention were compared with conventional solvent based pre-treatment compositions using identical laundry detergents and equipment. Further, the use of the pre-treatment compositions of the invention were compared to the use of conventional laundry detergents and equipment without a pre-treatment composition. In the panel test, the visual evaluation ranged from 1 (worst) to 10 (best). The laundry detergent used had a formulation disclosed in Falbaum et al., U.S. Pat. Nos. 5,523,000; 5,741,768 and 5,750,484.

The results of the experiment are displayed in the following table:

| PRE-TREATMENT | WASH STEP | APPEARANCE | PANEL TEST |
|---|---|---|---|
| None | Conventional Laundry Detergent and Phosphate Builder | Still Heavily Soiled | 0/10 |
| None | Conventional Laundry Detergent and Phosphate Builder combined with Example 2 | Black Blotches Remaining | 0/10 |
| Mineral spirits 64%, nonylphenol (9.5 mole) ethoxylate 24%, nonylphenol (12 mole) ethoxylate 12% | Conventional Laundry Detergent and Phosphate Builder | Black Blotches Remaining | 0/10 |
| Example 2 | Conventional Laundry Detergent and Phosphate Builder | Clean; With no Blotches | 10/10 |

The results of the test illustrate the benefit of the new pre-treatment compositions in a pretreatment step over solvent based technology. The data shows the ability of the materials to completely remove soils whereas the absence of the pre-treatment or the use of a solvent based pre-treatment did not remove soil satisfactorily.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A process for removing hydrophobic and particulate soil from laundry items, the process comprising the steps of:

(a) contacting a soiled laundry item with an aqueous treatment composition comprising an effective treating amount of a surfactant composition, the surfactant composition comprising about 50 wt. % to 100 wt. % of a hydrophobic ethoxylate surfactant having the formula:

$$R—(OC_2H_4)_m—OH$$

wherein R is a fatty aliphatic group having 10–24 carbon atoms and m is a number less than 2, the hydrophobic ethoxylate surfactant having an HLB value of between about 4 and about 9, and the aqueous treatment composition is substantially free of aliphatic hydrocarbons and aromatic hydrocarbons; and (b) laundering the treated laundry item with a conventional aqueous laundry detergent.

2. The process of claim 1 wherein the soil comprises used motor oil.

3. The process of claim 2 wherein the soil comprises used motor oil and particulate carbon.

4. The process of claim 1 wherein the laundry item comprises a polyester, a cotton, or a blend fabric thereof.

5. The process of claim 1 wherein the aqueous treatment composition comprises about 0.01 to 2 wt.-% of the ethoxylate surfactant in an aqueous medium.

6. A laundry pre-treatment composition for treating hydrophobic and organic particulate soils in a laundry item, the composition comprising a surfactant mixture comprising:

(a) an effective soil treating amount of a hydrophilic alkoxylate surfactant having an HLB value of about 10 to 20, the surfactant having the formula:

$$R_1—(OC_2H_4)_m—(OC_3H_6)_n—OH$$

wherein m and n are independently a number of about 0 to about 20, m+n>4 and $R_1$ is an aromatic or aliphatic, hydrophilic group of 6 to 24 carbon atoms; and (b) about 50 wt. % to 100 wt. %, based on the weight of the surfactant mixture, of a hydrophobic ethoxylate surfactant having an HLB value of between about 4 and about 9, the surfactant having the formula:

$$R_2—(OC_2H_4)_p—OH$$

wherein $R_2$ is a straight or branched chain fatty alkyl group containing from about 10 to 24 carbon atoms and p is a number of less than about 2;

wherein the laundry pre-treatment composition is substantially free of aliphatic hydrocarbons and aromatic hydrocarbons; and wherein the amounts of hydrophilic ethoxylate surfactant and hydrophobic ethoxylate surfactant are selected to provide a laundry pre-treatment composition having an overall HLB value of about 7–12 in the composition.

7. The composition of claim 6 further comprising a builder salt.

8. A laundry pre-treatment composition for treating hydrophobic and organic particulate soils in a laundry item, the composition comprising a surfactant mixture comprising:

(a) an effective soil treating amount of a first hydrophilic alkoxylate surfactant having an HLB value of about 10 to 20, the surfactant having the formula:

$$R_1—(OC_2H_4)_m—(OC_3H_6)_n—OH$$

wherein m and n are independently a number of about 0 to about 20, m+n>4 and $R_1$ is an aromatic or aliphatic, hydrophilic group of 1 to 18 carbon atoms;

(b) an effective soil treating amount of a second hydrophilic alkoxylate surfactant having an HLB value of about 10 to 20, the surfactant having comprising the formula:

$$R_2—(OC_2H_4)_p—(OC_3H_6)_q—OH$$

wherein $R_2$ is an aromatic or aliphatic group of 6 to 24 carbon atoms, p and q are numbers from about 0 to about 20, p+q>4;

(c) about 50 wt. % to 100 wt. %, based on the weight of the surfactant mixture, of a hydrophobic ethoxylate surfactant having an HLB value of about 4 to 9, the surfactant having the formula:

$$R_3—(OC_2H_4)_r—OH$$

wherein $R_3$ comprises a fatty aliphatic group having 10 to 24 carbon atoms and r comprises a number of less than 2;

wherein the laundry pre-treatment composition is substantially free of aliphatic hydrocarbons and aromatic hydrocarbons and the amounts of each surfactant composition is selected to provide the laundry pre-treatment composition with an HLB value of about 7 to about 12.

9. The composition of claim 8 wherein the hydrophobic ethoxylate surfactant comprises a mixed myristyl-lauryl fatty alcohol ethoxylate.

10. The composition of claim 8 wherein the laundry pre-treatment composition comprises an aqueous use solution comprising about 0.01 to about 5 wt.-% of the surfactant mixture.

11. The composition of claim 8 wherein the laundry pre-treatment composition comprises an aqueous concentrate solution comprising between about 50 to less than 100 wt-% of the surfactant mixture.

12. The composition of claim 8 wherein the laundry pre-treatment composition comprises a solid composition comprising the surfactant mixture dispersed in a solid forming agent.

13. The composition of claim 12 wherein the solid forming agent comprises polyethylene glycol having a molecular weight greater than about 5000.

14. The process of claim 1 wherein the step of laundering the treated laundry item comprises:

(i) introducing the treated laundry item into a vertical washer wheel; and (ii) laundering the treated laundry item in the vertical washer wheel.

15. The process of claim 1 wherein the step of contacting a soiled laundry item with an aqueous treatment composition comprises contacting the soiled laundry item with an aqueous treatment composition in a tunnel washer.

16. The process of claim 1 wherein the step of laundering the treated laundry item comprises pre-soaking the treated laundry item.

17. The composition of claim 6 wherein the composition comprises an aqueous composition comprising about 1 to about 50 wt. % of the hydrophobic alcohol ethoxylate composition and about 1 to about 50 wt. % of the hydrophilic alkoxylate surfactant composition.

18. The composition of claim 8, wherein the first hydrophilic ethoxylate surfactant composition comprises nonylphenol ethoxylate having less than 10 moles of ethylene oxide.

19. The composition of claim 8 wherein the second hydrophilic ethoxylate surfactant composition comprises nonylphenol ethoxylate having greater than 10 moles of ethylene oxide.

20. The composition of claim 8 wherein the hydrophobic ethoxylate surfactant comprises a fatty alcohol ethoxylate wherein the ethoxylate comprises a $C_{10-16}$ aliphatic alcohol ethoxylate having less than 2 moles of ethylene oxide.

21. The composition of claim 8 wherein the composition comprises:

(a) between about 1 and about 33 wt. % of the first hydrophilic alkoxylate surfactant composition; and (b) between about 1 and about 33 wt. % of the second hydrophilic alkoxylate surfactant composition.

* * * * *

UNITED STATES PATENT AND TRADEMARK OFFICE

CERTIFICATE OF CORRECTION

PATENT NO. : 6,204,233 B1
DATED : March 20, 2001
INVENTOR(S) : Smith et al.

It is certified that error appears in the above-identified patent and that said Letters Patent is hereby corrected as shown below:

Title page,
Insert -- [73] Assignee: Ecolab Inc., St. Paul, MN --.

Signed and Sealed this

First Day of January, 2002

*Attest:*

*Attesting Officer*

JAMES E. ROGAN
*Director of the United States Patent and Trademark Office*